US008646129B1

(12) United States Patent
Chen

(10) Patent No.: US 8,646,129 B1
(45) Date of Patent: Feb. 11, 2014

(54) ROCKING BED

(76) Inventor: Owen Chen, Taipei (TW)

( * ) Notice: Subject to any disclaimer, the term of this patent is extended or adjusted under 35 U.S.C. 154(b) by 0 days.

(21) Appl. No.: 13/568,191

(22) Filed: Aug. 7, 2012

(51) Int. Cl.
*A47D 9/02* (2006.01)

(52) U.S. Cl.
USPC ..... 5/109; 5/93.1; 5/101; 5/655

(58) Field of Classification Search
USPC ..... 5/11, 93.1, 101–109, 655
See application file for complete search history.

(56) References Cited

U.S. PATENT DOCUMENTS 2,873,458 A * 2/1959 Adamson ..... 5/98.1
3,125,767 A * 3/1964 Grigs ..... 5/109
4,785,797 A * 11/1988 Cuervo ..... 601/60
4,881,285 A * 11/1989 Zeeb ..... 5/103
6,934,981 B2 * 8/2005 Waldman et al. ..... 5/95
2004/0123383 A1 * 7/2004 Nguyen ..... 5/109

* cited by examiner

*Primary Examiner* — William Kelleher
*Assistant Examiner* — Myles Throop
(74) *Attorney, Agent, or Firm* — Alan Kamrath; Kamrath IP Lawfirm, P.A.

(57) ABSTRACT

A rocking bed includes a frame unit, a transmission unit connected with the frame unit to swing and rock the frame unit reciprocally, and a driving unit connected with the transmission unit to drive the transmission unit. Thus, the transmission unit is driven by the driving unit to drive the frame unit so that the frame unit is rocked reciprocally without needing a manual work.

7 Claims, 7 Drawing Sheets

ROCKING BED

BACKGROUND OF THE INVENTION

1. Field of the Invention

The present invention relates to a bed and, more particularly, to a rocking bed for infants.

2. Description of the Related Art

A conventional rocking bed comprises a support frame and a basket pivotally mounted on the support frame for placing babies. Thus, the user can move the basket to pivot and rock the basket relative to the support frame so as to provide a comfortable sensation to the babies placed in the basket. However, the user has to push and pull the basket successively so as to rock the basket reciprocally, thereby causing inconvenience to the user and wasting the user's time and energy.

BRIEF SUMMARY OF THE INVENTION

In accordance with the present invention, there is provided a rocking bed, comprising a frame unit, a transmission unit connected with the frame unit, and a driving unit connected with the transmission unit. The frame unit includes two bottom frames, two crossbars mounted between the bottom frames, four swinging brackets pivotally connected with the crossbars, two support frames pivotally connected with the swinging brackets, and a bed board connected with the support frames. Each of the crossbars of the frame unit is connected with two of the swinging brackets. Each of the crossbars of the frame unit is located at an upper portion of each of the bottom frames. Each of the support frames of the frame unit is connected with two of the swinging brackets. Each of the swinging brackets of the frame unit has an upper end pivotally connected with a respective one of the crossbars and a lower end pivotally connected with a lower portion of a respective one of the support frames. The bed board of the frame unit is located at a mediate portion of each of the support frames. The transmission unit includes a base secured on a bottom of the bed board of the frame unit and having a surface provided with at least two limit slots, a drawing bracket having a first end pivotally connected with one of the crossbars of the frame unit, a pivot block having a first end pivotally connected with a second end of the drawing bracket, a swinging arm having a first end pivotally connected with a second end of the pivot block and a second end provided with at least two spaced driven pieces, a support shaft mounted on the base, a transmission member pivotally connected with the support shaft and provided with at least two driving axles each extended through a respective one of the limit slots of the base and each pivotally connected with a respective one of the driven pieces of the swinging arm, a driving member having a first end pivotally connected with the support shaft, a rotation lever having a first end pivotally connected with a second end of the driving member, and at least one torsion spring biased between the transmission member and the driving member. The swinging arm of the transmission unit is pivotable relative to the pivot block in a horizontal direction. The driven pieces of the swinging arm of the transmission unit are aligned with the limit slots of the base respectively. The pivot block of the transmission unit is pivotable relative to the drawing bracket in a vertical direction. The driving member of the transmission unit is mounted in the transmission member. The torsion spring of the transmission unit is mounted on the driving member and has a first end pressing the transmission member and a second end pressing the driving member. The driving unit includes a drive motor, a driving gear rotatably mounted on the drive motor, a driven gear meshing with the driving gear, and a driving shaft secured on the driven gear eccentrically and pivotally connected with a second end of the rotation lever of the transmission unit. The driving shaft of the driving unit is deflected eccentrically from a central portion of the driven gear.

The primary objective of the present invention is to provide a rocking bed that is rocked reciprocally.

According to the primary advantage of the present invention, the bed board, the top frame, the support frames and the swinging brackets are rocked reciprocally relative to the bottom frames and the crossbars by successive operation of the drive motor so that the rocking bed is rocked reciprocally without needing a manual work, thereby facilitating a user taking care of babies placed in the rocking bed.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
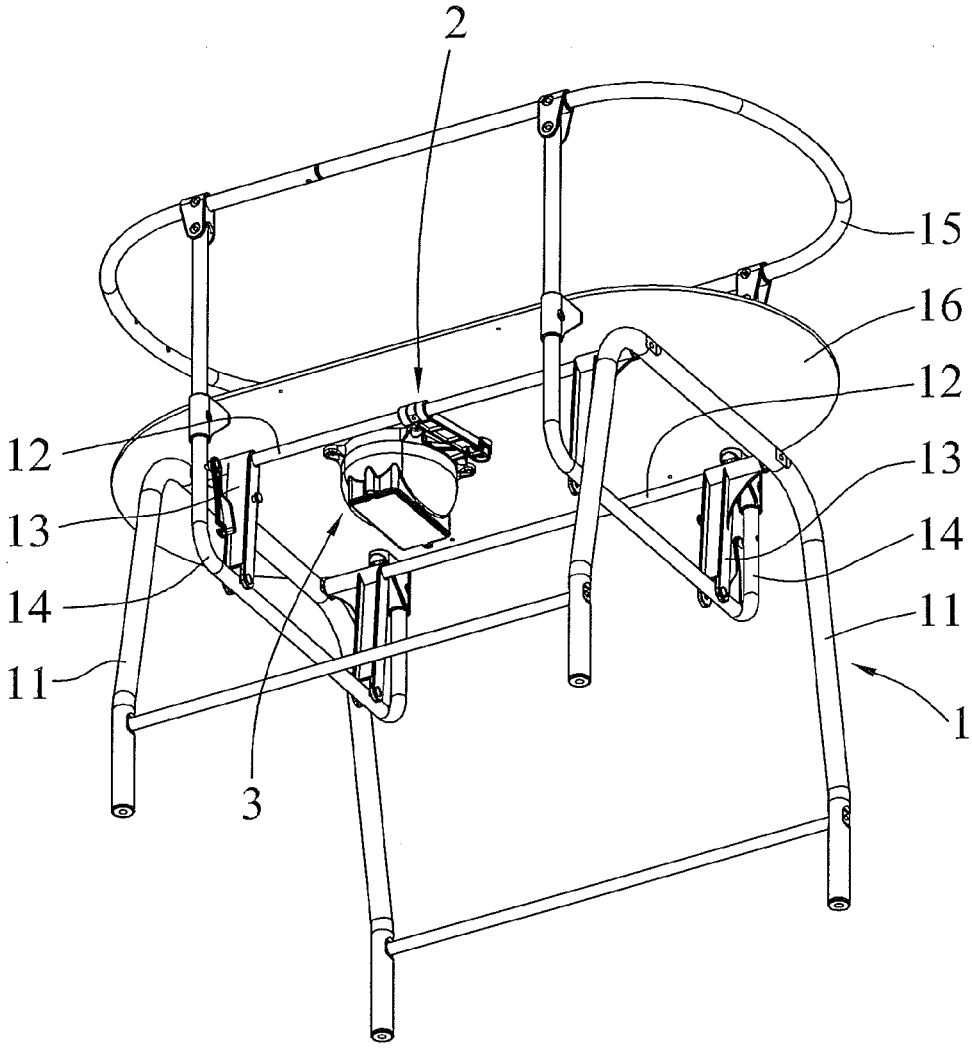
FIG. 1 is a perspective view of a rocking bed in accordance with the preferred embodiment of the present invention.

Referring to the drawings and initially to FIGS. 1-5, a rocking bed in accordance with the preferred embodiment of the present invention comprises a frame unit 1, a transmission unit 2 connected with the frame unit 1 to swing and rock the frame unit 1 reciprocally, and a driving unit 3 connected with the transmission unit 2 to drive the transmission unit 2.

The frame unit 1 includes two bottom frames 11 spaced from each other, two crossbars 12 mounted between the bottom frames 11, four swinging brackets 13 pivotally connected with the crossbars 12, two support frames 14 pivotally connected with the swinging brackets 13, a bed board 16 connected with the support frames 14, and a top frame 15 connected with the support frames 14.

The bottom frames 11 of the frame unit 1 are parallel with each other. Each of the bottom frames 11 of the frame unit 1 has a substantially inverted U-shaped profile. The bottom frames 11 and the crossbars 12 of the frame unit 1 construct a substantially rectangular support structure. The crossbars 12 of the frame unit 1 are parallel with each other and are perpendicular to the bottom frames 11. Each of the crossbars 12 of the frame unit 1 is connected with two of the swinging brackets 13. Each of the crossbars 12 of the frame unit 1 is located at an upper portion of each of the bottom frames 11. Each of the support frames 14 of the frame unit 1 has a substantially U-shaped profile. Each of the support frames 14 of the frame unit 1 is connected with two of the swinging brackets 13. Each of the swinging brackets 13 of the frame unit 1 has an upper end pivotally connected with a respective one of the crossbars 12 and a lower end pivotally connected with a lower portion of a respective one of the support frames 14. The bed board 16 of the frame unit 1 is located at a mediate portion of each of the support frames 14 and is disposed between the top frame 15 and each of the crossbars 12. The top frame 15 of the frame unit 1 is located at an upper portion of each of the support frames 14. A cover cloth is mounted on the top frame 15 of the frame unit 1 and is extended to the bed board 16 of the frame unit 1.

The transmission unit 2 includes a base 21 secured on a bottom of the bed board 16 of the frame unit 1 and having a surface provided with at least two limit slots 211, a drawing bracket 25 having a first end pivotally connected with one of the crossbars 12 of the frame unit 1, a pivot block 24 having a first end pivotally connected with a second end of the drawing bracket 25, a swinging arm 22 having a first end pivotally connected with a second end of the pivot block 24 and a second end provided with at least two spaced driven pieces 23, a support shaft 261 mounted on the base 21, a transmission member 26 pivotally connected with the support shaft 261 and provided with at least two driving axles 27 each extended through a respective one of the limit slots 211 of the base 21 and each pivotally connected with a respective one of the driven pieces 23 of the swinging arm 22, a driving member 28 having a first end pivotally connected with the support shaft 261, a rotation lever 29 having a first end pivotally connected with a second end of the driving member 28, and at least one torsion spring 281 biased between the transmission member 26 and the driving member 28.

The swinging arm 22 of the transmission unit 2 is disposed between the bed board 16 of the frame unit 1 and the base 21 and is partially protruded outward from the base 21. The swinging arm 22 of the transmission unit 2 is pivotable relative to the pivot block 24 in a horizontal direction. The driven pieces 23 of the swinging arm 22 of the transmission unit 2 are aligned with the limit slots 211 of the base 21 respectively. The pivot block 24 of the transmission unit 2 is pivotable relative to the drawing bracket 25 in a vertical direction. The support shaft 261 of the transmission unit 2 is located between the driving axles 27 of the transmission member 26. The driving member 28 of the transmission unit 2 is mounted in the transmission member 26. The torsion spring 281 of the transmission unit 2 is mounted on the driving member 28 and has a first end pressing the transmission member 26 and a second end pressing the driving member 28. In the preferred embodiment of the present invention, the transmission unit 2 includes two torsion springs 281 mounted on the driving member 28 symmetrically.

The driving unit 3 includes a drive motor 31, a driving gear 32 rotatably mounted on the drive motor 31, a driven gear 33 meshing with the driving gear 32, a driving shaft 34 secured on the driven gear 33 eccentrically and pivotally connected with a second end of the rotation lever 29 of the transmission unit 2, a casing 35 mounted on the base 21 of the transmission unit 2 to cover and protect the transmission member 26, the driving member 28, the rotation lever 29, the drive motor 31, the driving gear 32, the driven gear 33 and the driving shaft 34, a battery box 36 mounted in the casing 35, and a bottom cap 37 mounted on a bottom of the casing 35 to cover the battery box 36. Thus, the driving gear 32 is driven and rotated by the drive motor 31 to rotate the driven gear 33 which drives the driving shaft 34 which drives the rotation lever 29 to deflect and swing. The battery box 36 of the driving unit 3 contains at least one battery to provide an electric power to the drive motor 31. The driving shaft 34 of the driving unit 3 is deflected eccentrically from a central portion of the driven gear 33.

Figure 2:
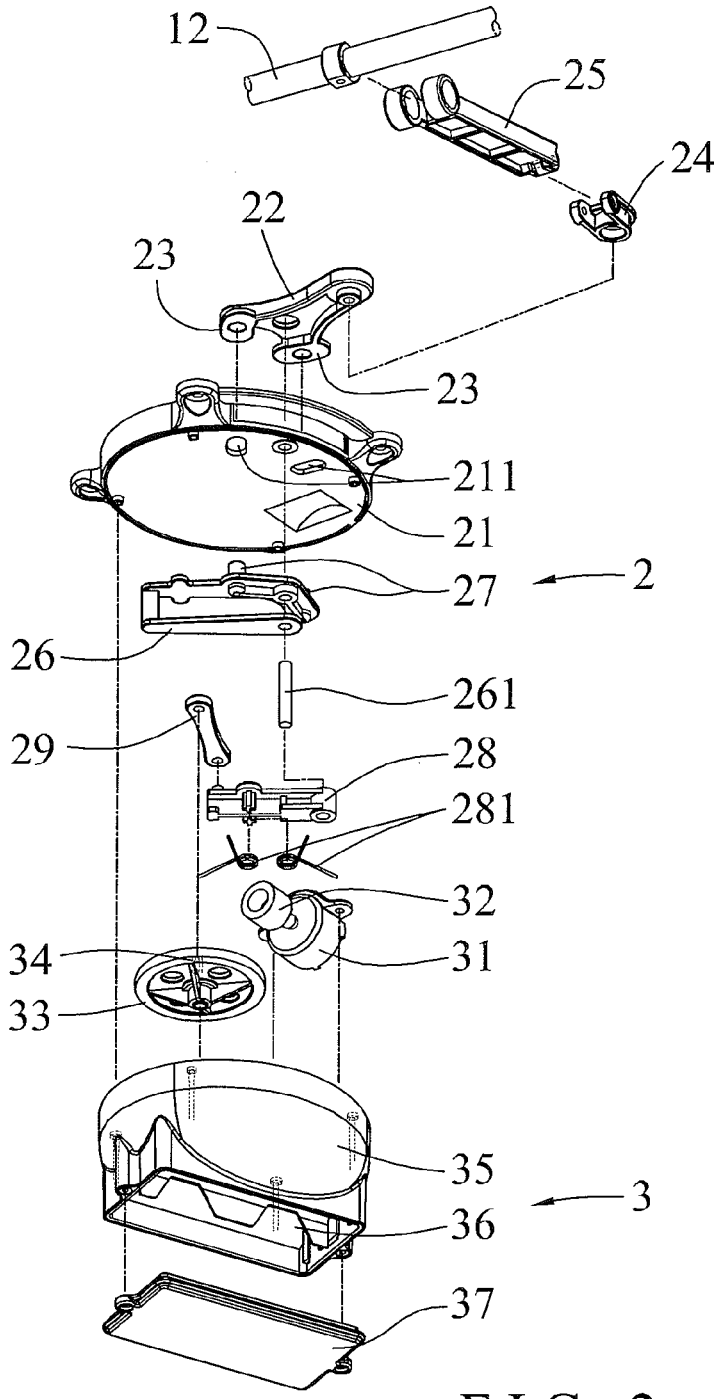
FIG. 2 is a partially exploded perspective view of the rocking bed as shown in FIG. 1.
Figure 3:
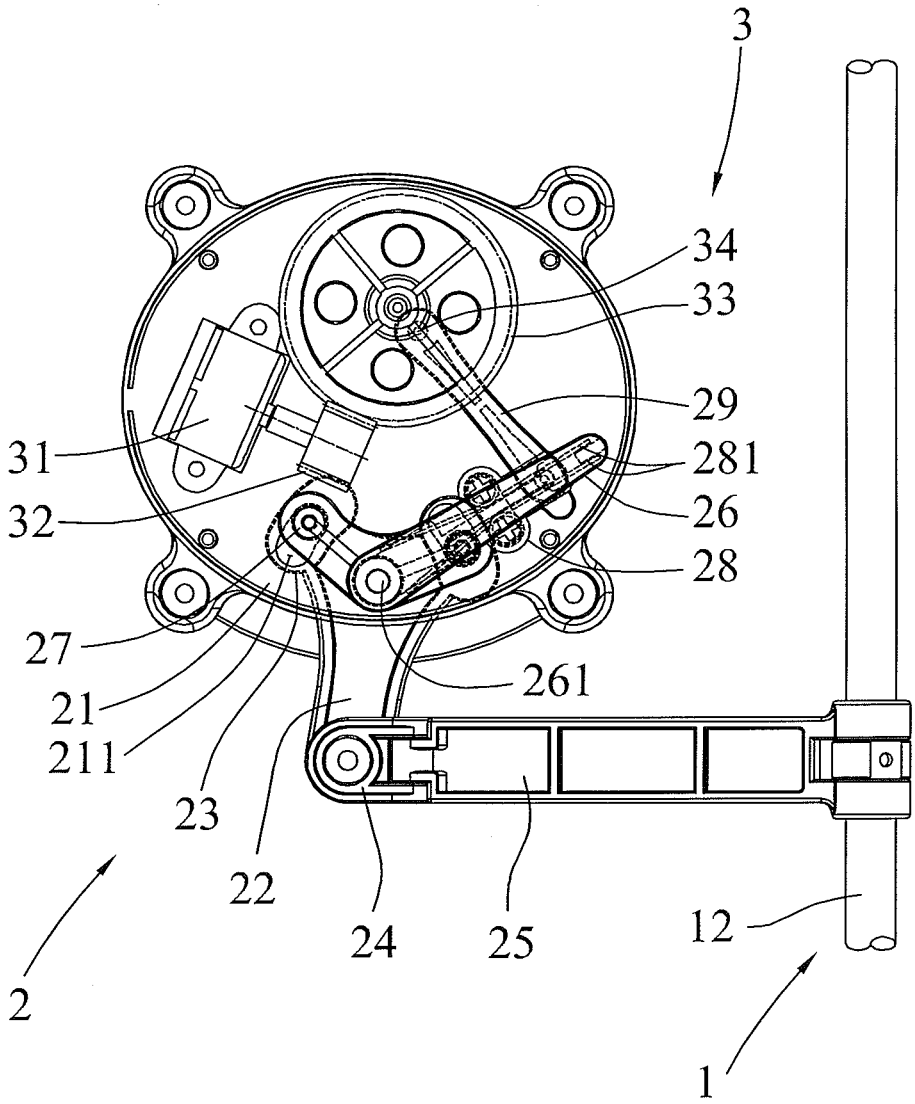
FIG. 3 is a partially top cross-sectional view of the rocking bed as shown in FIG. 1.
Figure 4:
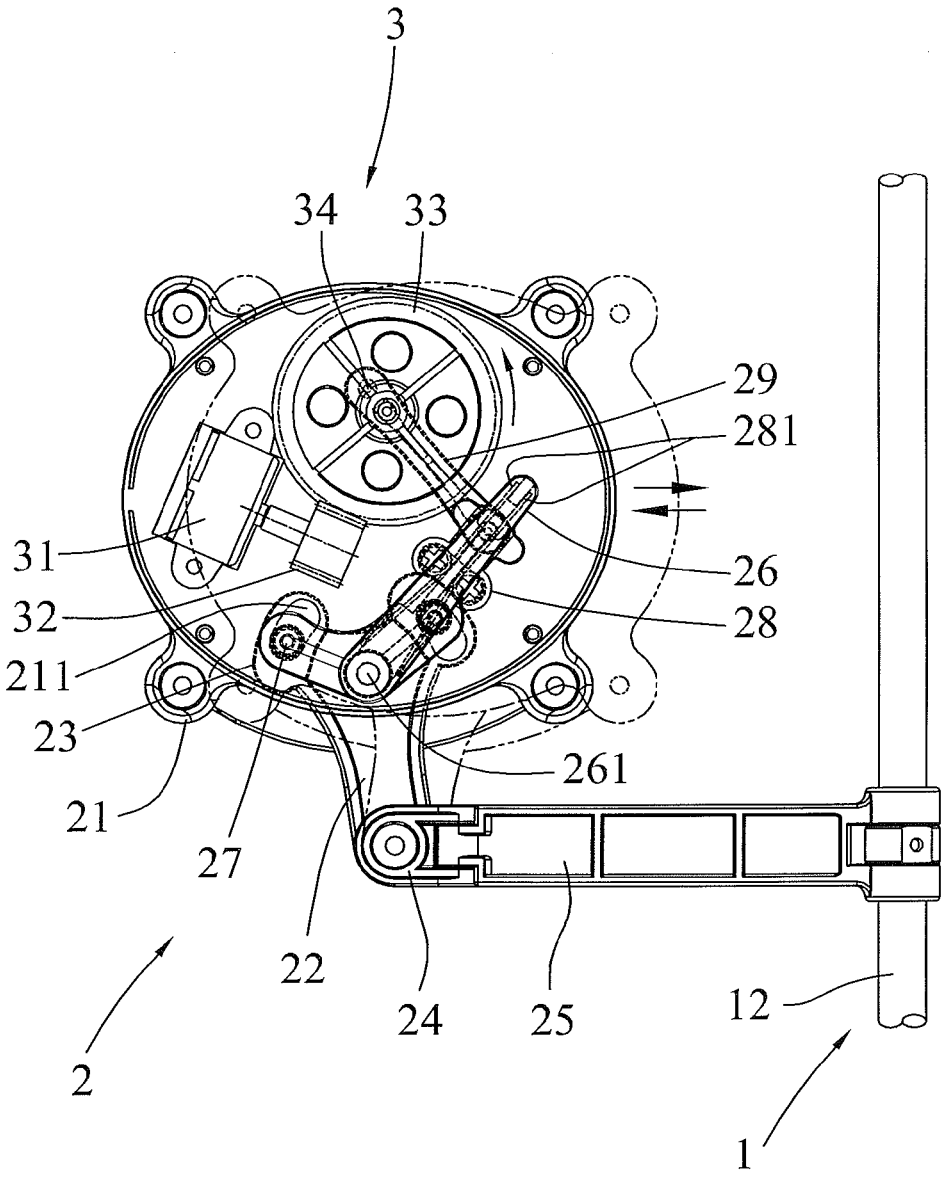
FIG. 4 is a schematic operational view of the rocking bed as shown in FIG. 3 in use.
Figure 5:
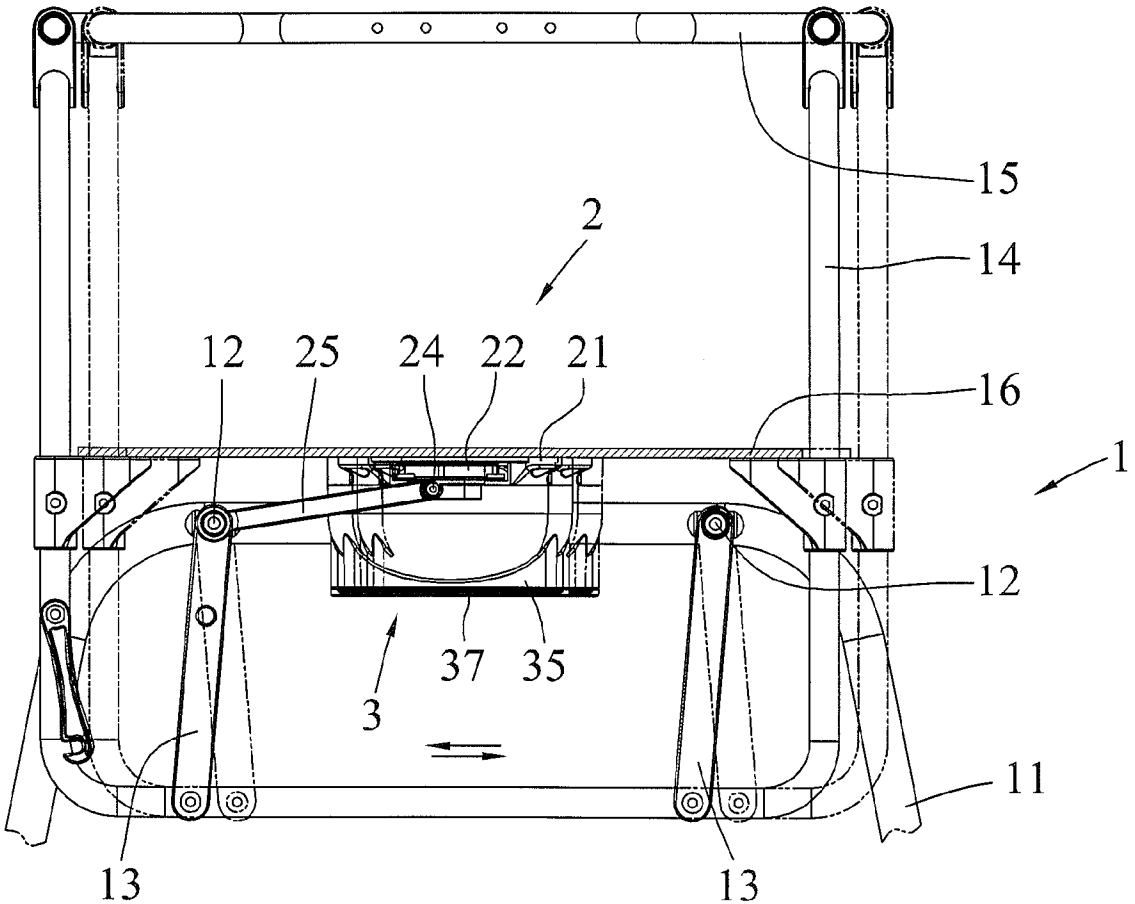
FIG. 5 is a side cross-sectional operational view of the rocking bed as shown in FIG. 1.

In operation, referring to FIGS. 3-5 with reference to FIGS. 1 and 2, when the drive motor 31 is operated, the driving gear 32 is driven and rotated by the drive motor 31 to rotate the driven gear 33 which drives the driving shaft 34 which drives the rotation lever 29 which drives the driving member 28 which pivots about the support shaft 261 and drives the torsion spring 281 which drives the transmission member 26 which pivots about the support shaft 261 and drives the driving axles 27 which are moved reciprocally in the limit slots 211 of the base 21 and drive the driven pieces 23 which drive the swinging arm 22 which drives the pivot block 24 which drives the drawing bracket 25. At this time, the drawing bracket 25 is fixed by one of the crossbars 12 of the frame unit 1 and cannot be moved by the pivot block 24, while the pivot block 24 cannot be moved by the swinging arm 22 so that the swinging arm 22 is pivoted horizontally about the pivot block 24. In such a manner, when the swinging arm 22 is pivoted about the pivot block 24, the driving axles 27 are moved reciprocally in the limit slots 211 of the base 21 to move the base 21 as shown in FIG. 4 which drives the bed board 16 which drives the support frames 14 which drive the swinging brackets 13 which are pivoted relative to the crossbars 12, so that the bed board 16 is driven by the base 21 and is rocked through the support frames 14 and the swinging brackets 13 as shown in FIG. 5. At the same time, the top frame 15 is also moved in concert with the support frames 14. Thus, the bed board 16, the top frame 15, the support frames 14 and the swinging brackets 13 are rocked reciprocally relative to the bottom frames 11 and the crossbars 12 by successive operation of the drive motor 31.

Figure 6:
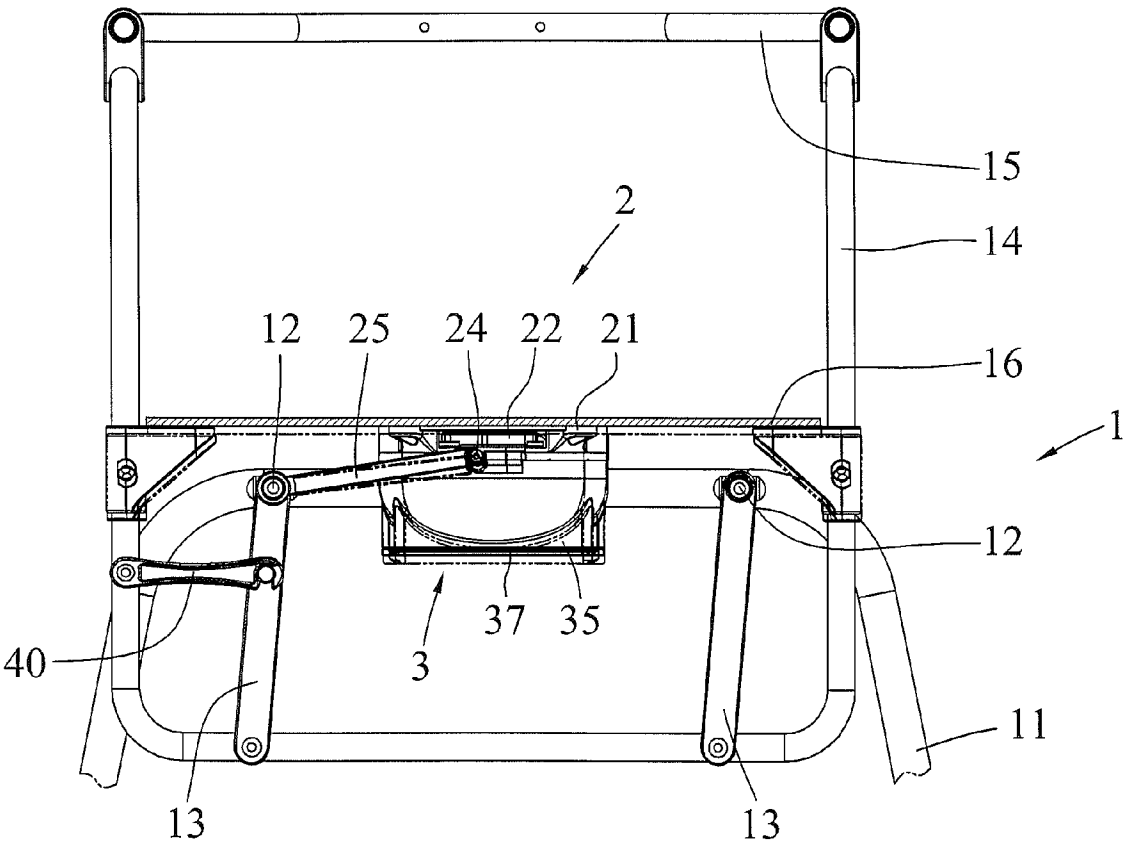
FIG. 6 is a schematic operational view of the rocking bed as shown in FIG. 5.
Figure 7:
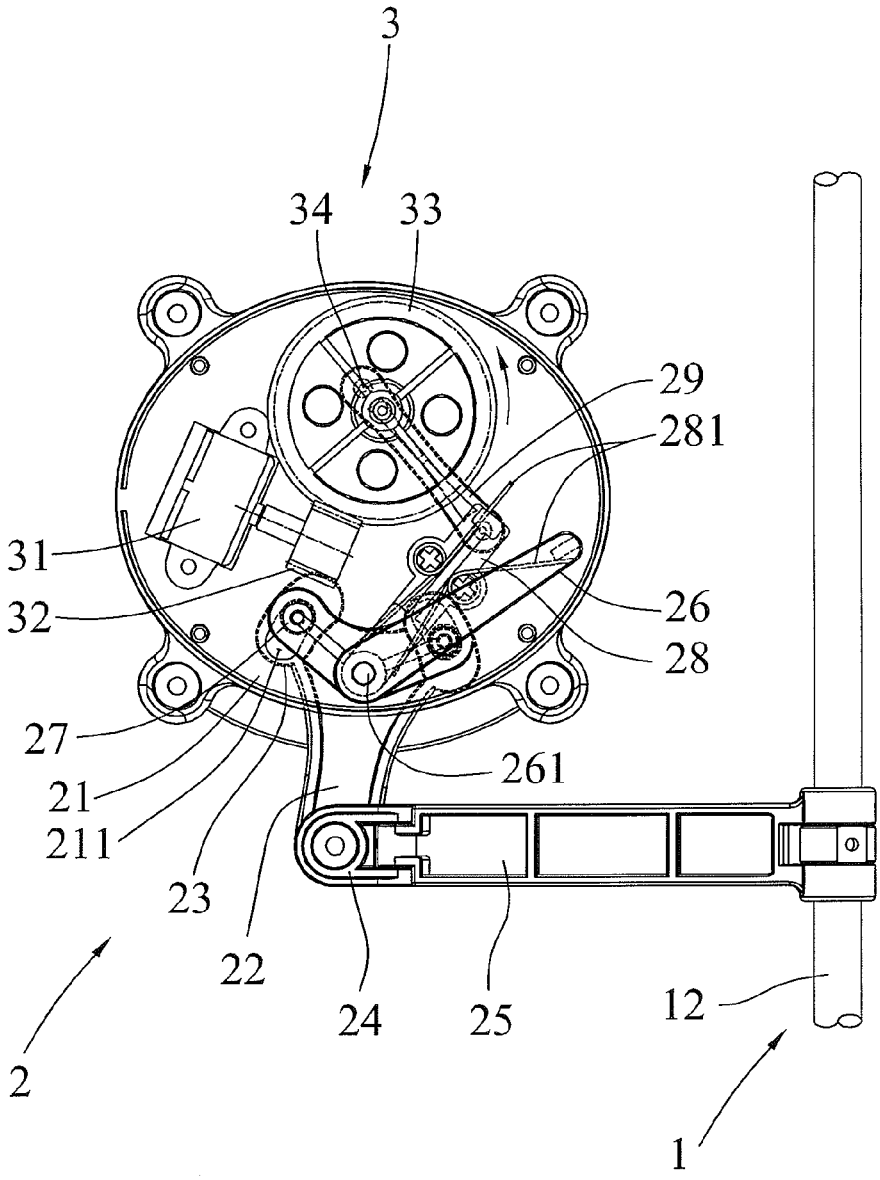
FIG. 7 is a schematic operational view of the rocking bed as shown in FIG. 3.

On the contrary, referring to FIGS. 6 and 7 with reference to FIGS. 1-5, the rocking bed further comprises at least one locking hook 40 pivotally connected with one of the support frames 14 and removably locked onto the swinging brackets 13. In operation, when the locking hook 40 is locked onto the swinging brackets 13, the support frames 14 and the swinging brackets 13 are locked so that the bed board 16 is disposed at a fixed state and cannot be rocked any more. In such a manner, when the drive motor 31 is operated successively, the driving gear 32 is driven and rotated by the drive motor 31 to rotate the driven gear 33 which drives the driving shaft 34 which drives the rotation lever 29 which drives the driving member 28 which pivots about the support shaft 261 and drives the torsion spring 281 which drives the transmission member 26. At the same time, the base 21 is fixed by the bed board 16 of the frame unit 1 so that the transmission member 26 is fixed by the base 21. Thus, when the driving member 28 drives the torsion spring 281 to drive the transmission member 26, the torsion spring 281 is compressed between the driving member 28 and the transmission member 26 and cannot drive the transmission member 26, so that the drive motor 31 idles to prevent the drive motor 31 from being worn or broken due to a jam between the driving member 28 and the transmission member 26.

Accordingly, the bed board 16, the top frame 15, the support frames 14 and the swinging brackets 13 are rocked reciprocally relative to the bottom frames 11 and the crossbars 12 by successive operation of the drive motor 31 so that the rocking bed is rocked reciprocally without needing a manual work, thereby facilitating a user taking care of babies placed in the rocking bed.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A rocking bed, comprising:

a frame unit;

a transmission unit connected with the frame unit; and a driving unit connected with the transmission unit;

wherein the frame unit includes:

two bottom frames;

two crossbars mounted between the bottom frames;

four swinging brackets pivotally connected with the crossbars;

two support frames pivotally connected with the swinging brackets; and a bed board connected with the support frames;

each of the crossbars of the frame unit is connected with two of the swinging brackets;

each of the crossbars of the frame unit is located at an upper portion of each of the bottom frames;

each of the support frames of the frame unit is connected with two of the swinging brackets;

each of the swinging brackets of the frame unit has an upper end pivotally connected with a respective one of the crossbars and a lower end pivotally connected with a lower portion of a respective one of the support frames;

the bed board of the frame unit is located at a mediate portion of each of the support frames;

the transmission unit includes:

a base secured on a bottom of the bed board of the frame unit and having a surface provided with at least two limit slots;

a drawing bracket having a first end pivotally connected with one of the crossbars of the frame unit;

a pivot block having a first end pivotally connected with a second end of the drawing bracket;

a swinging arm having a first end pivotally connected with a second end of the pivot block and a second end provided with at least two spaced driven pieces;

a support shaft mounted on the base;

a transmission member pivotally connected with the support shaft and provided with at least two driving axles each extended through a respective one of the limit slots of the base and each pivotally connected with a respective one of the driven pieces of the swinging arm;

a driving member having a first end pivotally connected with the support shaft;

a rotation lever having a first end pivotally connected with a second end of the driving member; and at least one torsion spring biased between the transmission member and the driving member;

the swinging arm of the transmission unit is pivotable relative to the pivot block in a horizontal direction;

the driven pieces of the swinging arm of the transmission unit are aligned with the limit slots of the base respectively;

the pivot block of the transmission unit is pivotable relative to the drawing bracket in a vertical direction;

the driving member of the transmission unit is mounted in the transmission member;

the torsion spring of the transmission unit is mounted on the driving member and has a first end pressing the transmission member and a second end pressing the driving member;

the driving unit includes:

a drive motor;

a driving gear rotatably mounted on the drive motor;

a driven gear meshing with the driving gear; and a driving shaft secured on the driven gear eccentrically and pivotally connected with a second end of the rotation lever of the transmission unit;

the driving shaft of the driving unit is deflected eccentrically from a central portion of the driven gear.

2. The rocking bed of claim 1, wherein each of the bottom frames of the frame unit has a substantially inverted U-shaped profile.

3. The rocking bed of claim 1, wherein the bottom frames and the crossbars of the frame unit construct a substantially rectangular support structure.

4. The rocking bed of claim 1, wherein each of the support frames of the frame unit has a substantially U-shaped profile.

5. The rocking bed of claim 1, wherein the frame unit further includes a top frame connected with the support frames;

the top frame of the frame unit is located at an upper portion of each of the support frames;

a cover cloth is mounted on the top frame of the frame unit and is extended to the bed board of the frame unit.

6. The rocking bed of claim 1, wherein the driving unit further includes a casing mounted on the base of the transmission unit to cover and protect the transmission member, the driving member, the rotation lever, the drive motor, the driving gear, the driven gear and the driving shaft.

7. The rocking bed of claim 6, wherein the driving unit further includes:

a battery box mounted in the casing; and a bottom cap mounted on a bottom of the casing to cover the battery box;

the battery box of the driving unit contains at least one battery to provide an electric power to the drive motor.

* * * * *